US010196877B2

(12) United States Patent
Weintraub

(10) Patent No.: US 10,196,877 B2
(45) Date of Patent: Feb. 5, 2019

(54) MODULAR DIRECTIONAL CONTROL VALVE

(71) Applicant: Proserv Operations, Inc., Houston, TX (US)

(72) Inventor: Preston Weintraub, Spring, TX (US)

(73) Assignee: Proserv Operations, Inc., Houston, TX (US)

( * ) Notice: Subject to any disclaimer, the term of this patent is extended or adjusted under 35 U.S.C. 154(b) by 590 days.

(21) Appl. No.: 14/523,424

(22) Filed: Oct. 24, 2014

(65) Prior Publication Data

US 2015/0191996 A1 Jul. 9, 2015

Related U.S. Application Data

(60) Provisional application No. 61/923,616, filed on Jan. 3, 2014.

(51) Int. Cl.
*E21B 34/10* (2006.01)

(52) U.S. Cl.
CPC ..... *E21B 34/101* (2013.01); *Y10T 137/4807* (2015.04); *Y10T 137/4857* (2015.04)

(58) Field of Classification Search
CPC ..... E21B 34/101
USPC ..... 251/366, 367; 137/263, 266, 884
See application file for complete search history.

(56) References Cited

U.S. PATENT DOCUMENTS 1,654,642 A * 1/1928 Geissinger ..... F23K 5/147 251/129.16
4,444,216 A * 4/1984 Loup ..... F16K 11/0655 137/115.15
4,475,568 A * 10/1984 Loup ..... F16K 11/0655 137/115.15
4,493,335 A * 1/1985 Watson ..... F16K 11/0655 137/116.3
4,554,940 A 11/1985 Loup
4,856,557 A 8/1989 Watson
6,523,613 B2 2/2003 Rayssiguier et al.
6,843,266 B2 * 1/2005 Hope ..... G05D 16/10 137/116.3
6,983,803 B2 * 1/2006 Watson ..... E21B 49/10 166/250.02
7,000,890 B2 * 2/2006 Bell ..... E21B 34/04 251/129.15
9,121,244 B2 * 9/2015 Loretz ..... E21B 34/06

OTHER PUBLICATIONS

U.S. Appl. No. 14/067,398, filed Oct. 30, 2013, Weintraub et al.

* cited by examiner

*Primary Examiner* — R. K. Arundale
*Assistant Examiner* — Daphne M Barry
(74) *Attorney, Agent, or Firm* — Patterson + Sheridan, LLP

(57) ABSTRACT

A directional control valve includes: a base and a slider longitudinally movable relative to the base. The base includes: a rectangular body having a longitudinal bore, a transverse bore, and a chamber formed at an intersection between the bores; supply and function seal plates, each having a stinger disposed in the transverse bore, one or more receptacles, and a passage extending from each receptacle through the stinger; and a supply, first function, and second function blocks, each fastened to the body and having a stinger disposed in the respective receptacle and a coupling for connection to a flow line. The slider includes: a sliding seal assembly disposed in the chamber; and an operating rod fastened to the seal assembly.

19 Claims, 6 Drawing Sheets

MODULAR DIRECTIONAL CONTROL VALVE

BACKGROUND OF THE DISCLOSURE

Field of the Disclosure

The present disclosure generally relates to a modular directional control valve.

Description of the Related Art

Downhole tools are frequently used in the drilling and/or evaluation stage of a crude oil and/or natural gas well. Such tools may be operated by drilling fluid pumped down a drill string and/or via control signal sent down wireline. Such tools may also be in fluid communication with wellbore fluid. The operation of such tools may require an onboard directional control valve to selectively operate various functions of a single tool or various tools of a tool string, such as a bottomhole assembly. Known directional control valves are complex to assemble leading to substantial risk of incorrect assembly. Known directional control valves are also bulky making them unsuitable for fitting within walls of or annuli between oilfield tubulars.

It is therefore desirable to provide a directional control valve that is easily assembled and is as small as practicable. The aforementioned characteristics are desirable so long as the valve efficiently provides an accurate and sufficient pressure to associated downhole applications.

SUMMARY OF THE DISCLOSURE

The present disclosure generally relates to a modular directional control valve. In one embodiment, a directional control valve includes: a base and a slider longitudinally movable relative to the base. The base includes: a rectangular body having a longitudinal bore, a transverse bore, and a chamber formed at an intersection between the bores; a supply seal plate having a first stinger disposed in the transverse bore, a first receptacle, and a passage extending from the first receptacle through the first stinger; a supply block fastened to the body and having a second stinger disposed in the first receptacle and a first coupling for connection to a flow line; a function seal plate having a third stinger disposed in the transverse bore, second and third receptacles, and passages extending from the second and third receptacles through the third stinger; and first and second function blocks fastened to the body and having respective fourth and fifth stingers disposed in the respective second and third receptacles and respective second and third couplings for connection to flow lines. The slider includes: a sliding seal assembly disposed in the chamber; and an operating rod fastened to the seal assembly.

In another embodiment, a directional control valve includes: a base and a slider longitudinally movable relative to the base. The base includes: a rectangular body having a seal bore and a chamber; a supply seal plate engaged with the seal bore and having a supply passage formed therethrough; a supply block fastened to the body and engaged with the supply seal plate; a function seal plate engaged with the seal bore and having first and section function passages formed therethrough; and first and second function blocks fastened to the body and engaged with the function seal plate. The slider includes: a sliding seal assembly disposed in the chamber; and an operating rod fastened to the seal assembly.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

FIGS. 1A-1E are external views of a modular directional control valve 1, according to one embodiment of the present disclosure. FIG. 1F is a cross section of FIG. 1C. FIG. 2A is a cross section of FIG. 1D with the valve 1 in a closed position. FIG. 2B is an enlargement of FIG. 2A illustrating a sliding seal assembly 10 of the valve 1. FIG. 2C is an external view of the sliding seal assembly 10. Unless otherwise specified, parts, other than seals and backup rings, of the valve 1 may each be made from a high strength metal or alloy, such as steel, stainless steel, or nickel-chromium alloy. Unless otherwise specified, seals may be made from an elastomer or elastomeric copolymer. Backup rings may be made from an engineering polymer.

Figure 3:
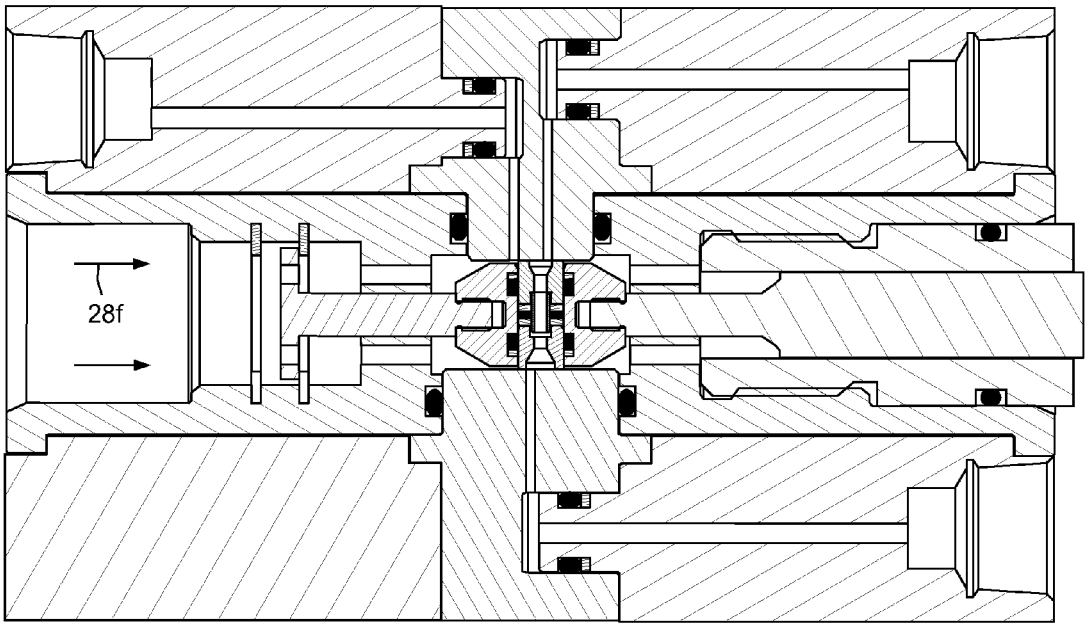
FIG. 3 is a cross section with the valve in a first function position.
Figure 4:
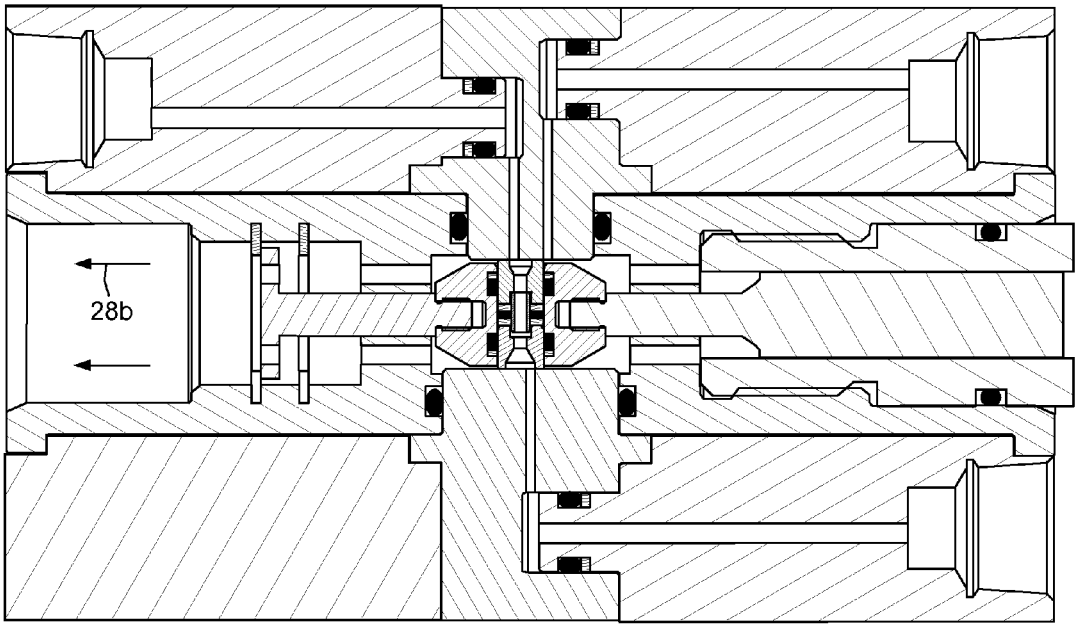
FIG. 4 is a cross section with the valve in a second function position.

The valve 1 may include a base 1*b* and a slider 1*s* longitudinally movable relative to the base between the closed position (shown), a first function position (FIG. 3), and a second function position (FIG. 4). The base 1*b* may include a body 2, a supply block 3, a first function block 4, a second function block 5, a dummy bock 6, a supply seal plate 7, a function seal plate 8, and a housing 9. The slider 1*s* may include a sliding seal assembly 10, an operating rod 12, and a stopping rod 13. The sliding seal assembly 10 may include a carrier 14, a supply seal 15, a function seal 16, a gland 17, and a spring 18.

Figure 1A:
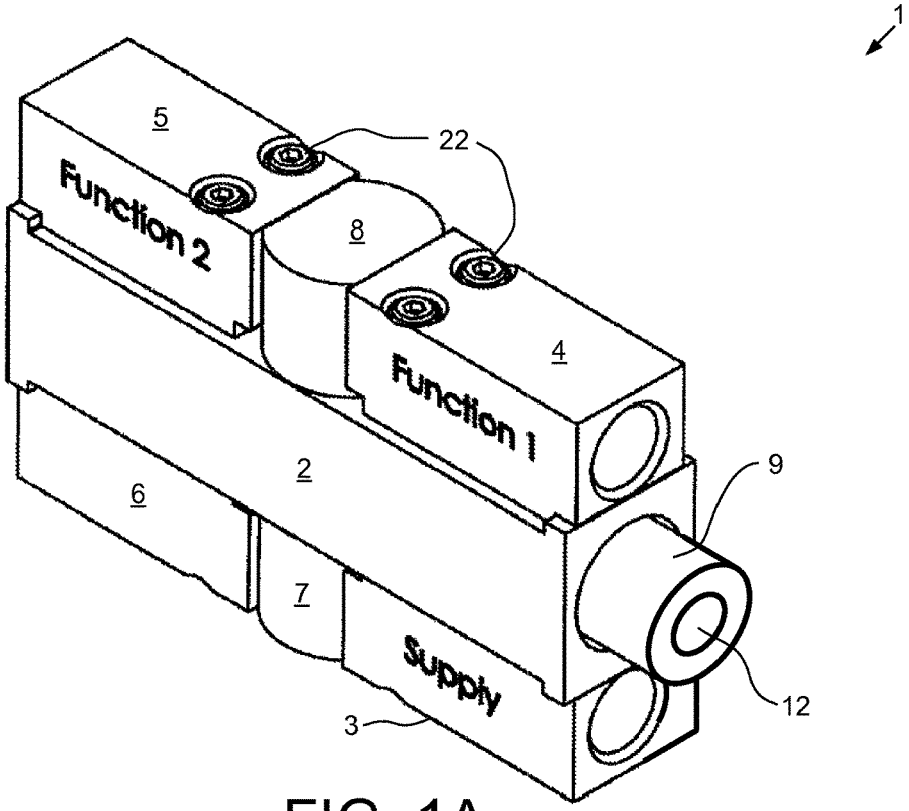
FIGS. 1A-1E are external views of a modular directional control valve, according to one embodiment of the present disclosure.
Figure 1B:
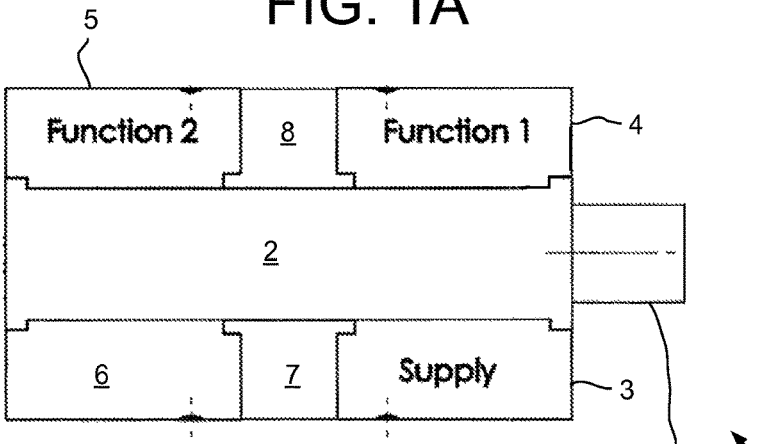
Figure 1C:
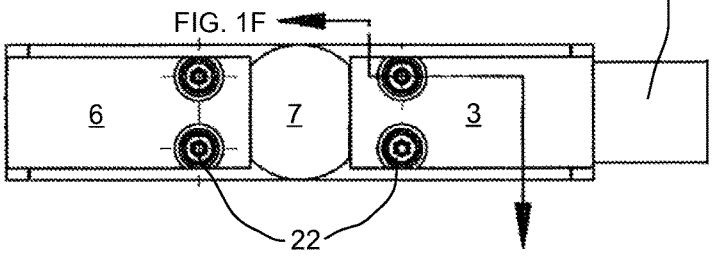
Figures 1D, 1E, 1F:
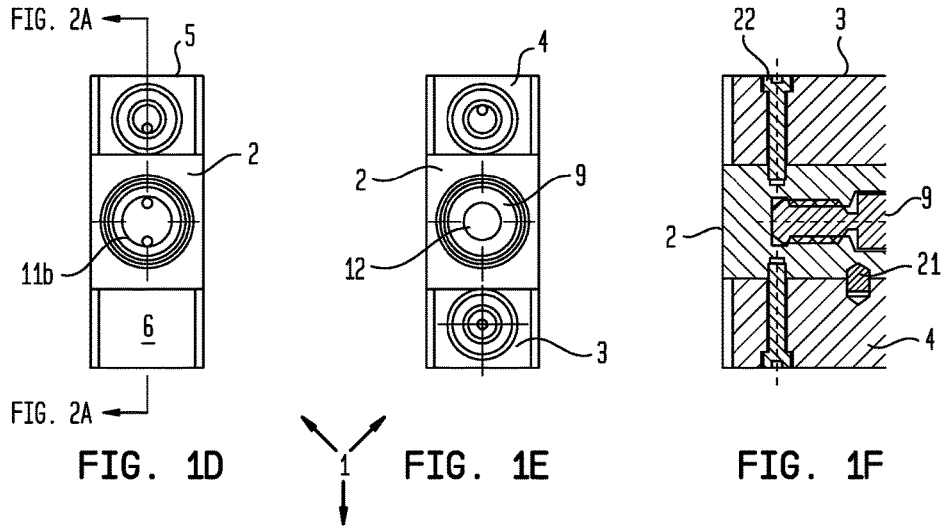
FIG. 1F is a cross section of FIG. 1C.
Figure 2A:
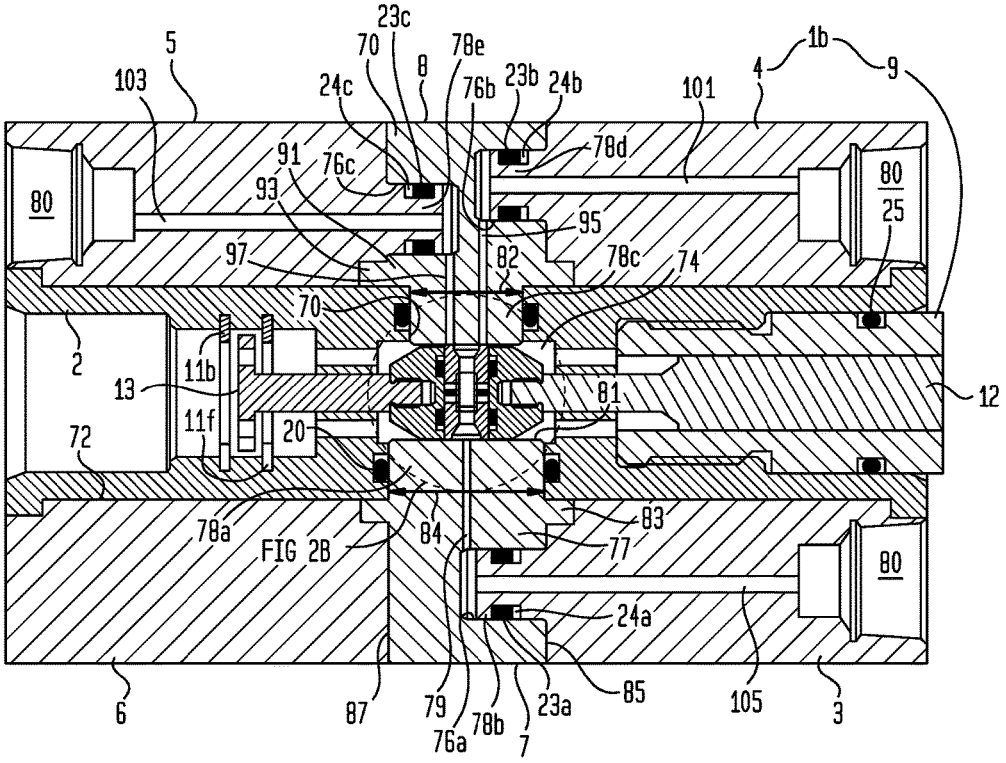
FIG. 2A is a cross section of FIG. 1D with the valve in a closed position.
Figure 2B:
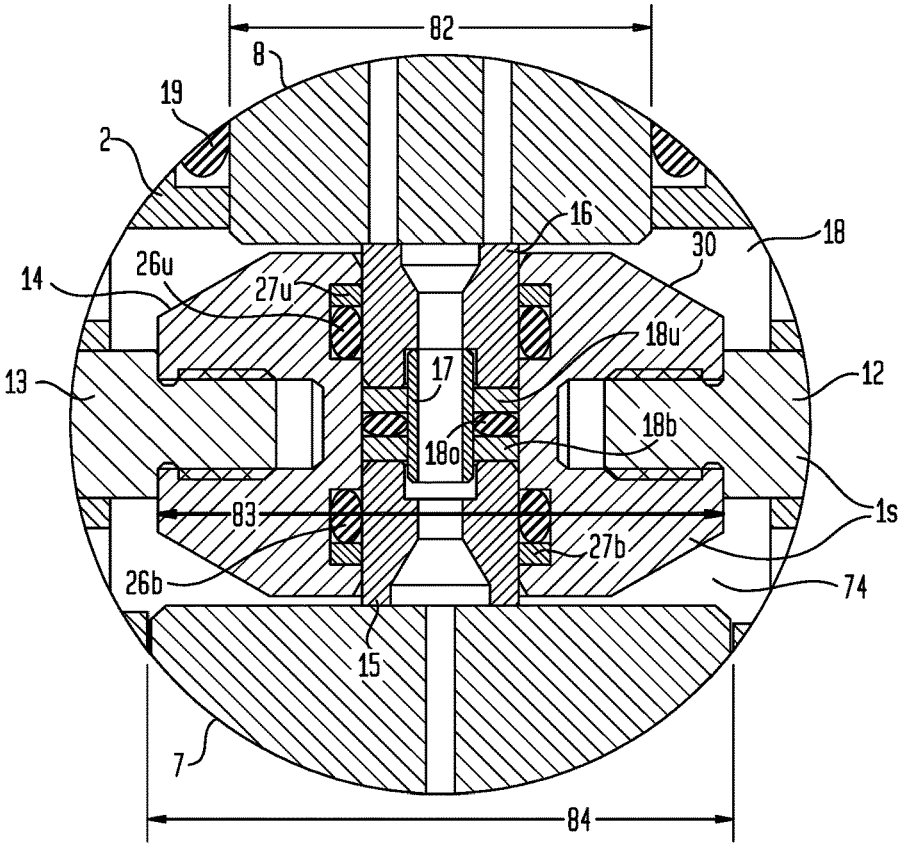
FIG. 2B is an enlargement of FIG. 2A illustrating a sliding seal assembly of the valve.
Figure 2C:
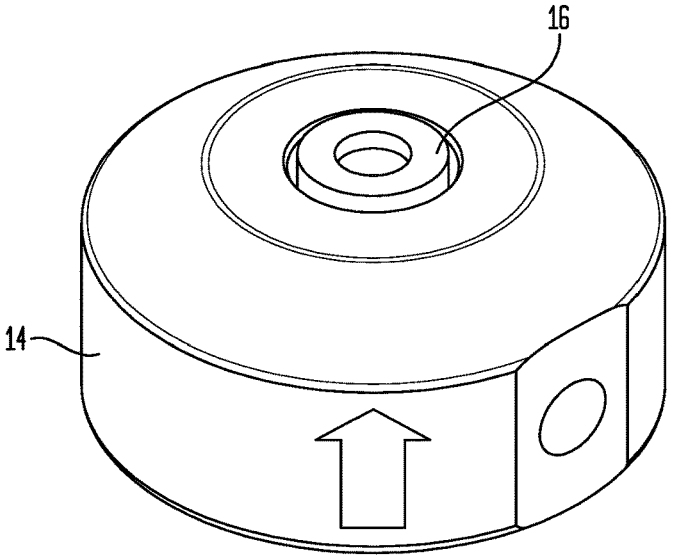
FIG. 2C is an external view of the sliding seal assembly.

The body 2 may be a rectangular block having an upper face, a lower face (partially shown in FIG. 1C), a left face (FIG. 1B), a right face, a front face (FIG. 1E), and a back face (FIG. 1D). The body 2 may also have a longitudinal bore 72 formed through the front and back faces thereof and a transverse bore 70 formed through the upper and lower faces thereof. Each body bore may be centrally located and the bores may intersect to form a chamber 74. The front and back faces of the body 2 may be square. The slider 1*s* may be disposed in the longitudinal body bore. The body 2 may have a coupling 80 formed in an inner surface thereof adjacent to the longitudinal bore 72 and located along a front portion of the body. The coupling 80 may receive the housing 9 and may have a threaded box and a seal receptacle 76.

The body 2 may have a stop receptacle 76 formed in an inner surface thereof adjacent to the longitudinal bore 72 and located along a rear portion of the body. The stop receptacle 76 may receive the stopping rod 13 and have a pair of grooves formed in the body inner surface. A front stopper 11*f* and a rear stopper 11*b*, such as snap rings, may be disposed in the respective grooves. The body 2 may also have a guide wall formed in a mid-portion thereof between the coupling 80, stop receptacle 76, and the chamber 74. The guide wall may have one or more (pair shown) front ports formed through a front portion thereof adjacent to the coupling 80 and one or more (pair shown) rear ports formed through a rear portion thereof adjacent to the stop receptacle 76.

To prevent assembly error, an upper portion of the body transverse bore 70 may have a different diameter than a lower portion thereof, such as the upper portion having a smaller diameter 82 than the lower portion. The diameter 84 of the lower portion of the body transverse bore 70 (lower diameter 84) may be greater than or equal to an outer diameter 83 of the seal carrier 14 to allow insertion of the sliding seal assembly 10 therethrough into the body chamber 74. The seal carrier 14 may have an orientation identifier engraved in an outer surface thereof, such as by laser etching or dot peening, to prevent erroneous insertion upside down.

Alternatively, the upper portion of the transverse bore 70 may have the larger diameter (upper diameter 82) for receiving the sliding seal assembly 10 and the lower portion may have the smaller diameter.

An upper surface of the body 2 adjacent to the body transverse bore 70 may have a seal groove formed therein and a seal, such as an o-ring 19, may be disposed therein. A lower surface of the body 2 adjacent to the body transverse bore 70 may have a seal groove formed therein and a seal, such as an o-ring 20, may be disposed therein.

Also to prevent assembly error, the body 2 may have a plurality of indentations (not shown) formed in the upper face thereof and a plurality of indentations (only one shown) formed in the lower face thereof. A locator, such as a dowel pin 21, may be disposed in each indentation and connected to the body 2, such as by interference fit. The upper indentations may be asymmetrically arranged along the front and rear portions of the body upper face such that an upper assembly including the function blocks 4, 5 and the function seal plate 8 cannot be installed backwards. The lower indentations may be asymmetrically arranged along front and rear portions of the body lower face such that a lower assembly including the supply 3 and dummy 6 blocks and the supply seal plate 7 cannot be installed backwards. Each of the body upper and lower faces may be recessed and form a flange at longitudinal ends thereof for retaining the respective upper and lower assemblies thereon.

The body 2 may have a plurality of threaded sockets formed in the upper face thereof and a plurality of threaded sockets (only one shown) formed in the lower face thereof. The upper face front and rear portions and the lower face front and rear portions may each have a pair of the threaded sockets. A threaded shank of a fastener 22 may be received in each threaded socket for connection of the upper and lower assemblies.

The supply seal plate 7 may have a lower receiver 77, an upper stinger 78*a* (first stinger), and a flange 83 connecting the lower receiver and the upper stinger 78*a*. The lower receiver 77 may have a double truncated cylindrical shape, the flange 83 may be cylindrical, and the first stinger 78*a* may be cylindrical having a reduced diameter relative to an enlarged diameter of the flange. The lower receiver 77 may have a flat front face 85 for engagement with the supply block 3 and a flat rear face 87 for engagement with the dummy block 6. The lower receiver 77 may also have a receptacle 76*a* (first receptacle) extending from the flat front face 85 to a mid portion thereof. The supply seal plate 7 may also have a supply passage 79 extending from the seal receptacle 76*a*, through the stinger 78 portion, and to an upper face 81 thereof.

The supply block 3 may have a front coupling 80 (first coupling), a cylindrical rear stinger 78*b* (second stinger), and a channel extending from the coupling 80 and through the stinger 78*b*. The front coupling 80 may be threaded for connecting with a mating coupling 80 of a supply flow line (not shown). To prevent installation error, the supply block 3 may have an identifier engraved in one or both sides thereof, such as by laser etching or dot peening. The supply block 3 may also have one or more indentations formed in an upper face thereof for mating with the respective dowel pins 21.

A seal groove may be formed in an outer surface of the stinger 78*b* and a seal, such as an o-ring 23*a*, and a backup ring 24*a* may be disposed in the seal groove for isolating an interface between the supply block 3 and the supply seal plate 7. The o-ring 23*a* may be located in the seal groove adjacent the supply seal plate 7 and the backup ring 24*a* located distal from the supply seal plate. The o-ring 23*a* may have a large cross-sectional diameter relative to the ring diameter, such as a ratio (cross-sectional diameter divided by ring diameter) greater than or equal to two-tenths.

The supply block 3 may also have one or more (one shown) holes (FIG. 1F), each hole extending through upper and lower faces thereof for receiving the respective fasteners 22. Each hole may be located at a periphery of the supply block 3 so as to straddle the supply channel without intersecting therewith. Each hole may be counterbored (shown) or countersunk (not shown) so that a head of the respective fastener 22 is flush or sub-flush with the lower face of the supply block 3. The supply block 3 may also have a rear shoulder formed in an upper portion thereof for mating with an adjacent portion of the supply seal plate flange and a front shoulder formed in the upper portion thereof for mating with the respective body flange.

The dummy block 6 may have one or more indentations formed in an upper face thereof for mating with the respective dowel pins 21. The dummy block 6 may also have one or more (not shown) holes, each hole extending through upper and lower faces thereof for receiving the respective fasteners 22. Each hole may be located at a periphery of the dummy block 6. Each hole may be counterbored (shown) or countersunk (not shown) so that a head of the respective fastener 22 is flush or sub-flush with the lower face of the dummy block 6. The dummy block 6 may also have a front shoulder formed in an upper portion thereof for mating with an adjacent portion of the supply seal plate flange and a rear shoulder formed in the upper portion thereof for mating with the respective body flange.

To form the lower assembly, the stinger 78 of the supply block 3 may be stabbed into the receptacle 76*a* of the supply seal plate 7 until the rear face of the supply block engages the front flat face 85 of the supply seal plate 7 and the rear shoulder of the supply block engages the adjacent portion of the flange of the supply seal plate. To prevent assembly error, the receptacle 76*a* of the supply seal plate 7 and the stinger 78 of the supply block 3 may be asymmetric such that the receptacle 76*a* will not accept the (incorrect) function blocks 4, 5.

The front shoulder of the dummy block 6 may then be engaged with the adjacent portion of the flange of the supply seal plate 7 and the adjacent flat faces engage (or the dummy block 6 may be assembled after the supply block 3 and supply seal plate 7 are fastened to the body 2). Assuming the sliding seal assembly 10 has already been inserted into the body chamber 74, the upper stinger 78 of the supply seal plate 7 may then be stabbed into the lower transverse bore 70 of the body 2 while ensuring the indentations of the supply 3 and dummy 6 blocks receive the respective dowel pins 21 and until the flange 83 of the supply seal plate 7 engages the body lower face and the front shoulder of the supply block 3 engages the front flange of the body 2. During stabbing, the o-ring 20 may engage the upper stinger 78 of the supply seal plate 7, thereby isolating an interface between the supply seal plate and the body 2. The fasteners 22 may then be inserted into the respective holes of the supply block 3 and dummy block 6 and screwed into the respective sockets of the body 2, thereby connecting the lower assembly to the body.

The function seal plate 8 may have an upper receiver 91, a lower stinger 78*c* (third stinger), and a flange 93 connecting the upper receiver and the lower stinger 78*c*. The upper receiver 91 may have a double truncated cylindrical shape, the flange 93 may be cylindrical, and the lower stinger 78 may be cylindrical having a reduced diameter relative to an enlarged diameter of the flange 93. The upper receiver 91 may have a flat front face for engagement with the first function block 4 and a flat rear face for engagement with the second function block 5. The upper receiver 91 may also have a front and rear receptacles 76*b,c* (second and third receptacles), extending from the respective flat faces thereof to a mid portion thereof without intersecting. The function seal plate 8 may also have non-intersecting front and rear passages 95, 97 first and second functional passages), each passage extending from the respective receptacle 76*b, c*, through the lower stinger 78*c* portion, and to a lower face thereof.

The first function block 4 may have a front coupling 80 (second coupling), a cylindrical rear stinger 78*d* (fourth stinger), and a channel 101 extending from the coupling 80 and through the cylindrical rear stinger 78*d*. The front coupling 80 may be threaded for connecting with a mating coupling 80 of a first function flow line (not shown). To prevent installation error, the first function block 4 may have an identifier engraved in one or both sides thereof, such as by laser etching or dot peening. The first function block 4 may also have one or more indentations formed in a lower face thereof for mating with the respective dowel pins 21.

A seal groove may be formed in an outer surface of the cylindrical rear stinger 78*d* and a seal, such as an o-ring 23*b*, and a backup ring 24*b* may be disposed in the seal groove for isolating an interface between the first function block 4 and the function seal plate 8. The o-ring 23*b* may be located in the seal groove adjacent the function seal plate 8 and the backup ring 24*b* located distal from the function seal plate 8. The o-ring 23*b* may have a large cross-sectional diameter relative to the ring diameter, such as a ratio (cross-sectional diameter divided by ring diameter) greater than or equal to two-tenths.

The first function block 4 may also have one or more (one shown) holes, each hole extending through upper and lower faces thereof for receiving the respective fasteners 22. Each hole may be located at a periphery of the first function block 4 so as to straddle the first function channel without intersecting therewith. Each hole may be counterbored or countersunk so that a head of the respective fastener 22 is flush or sub-flush with the upper face of the first function block 4. The first function block 4 may also have a rear shoulder formed in a lower portion thereof for mating with an adjacent portion of the function seal plate flange 93 and a front shoulder formed in the lower portion thereof for mating with the respective body flange.

The second function block 5 may have a rear coupling 80 (third coupling), a cylindrical front stinger 78*e* (fifth stinger), and a channel 103 extending from the coupling 80 and through the front stinger 78*e*. The rear coupling 80 may be threaded for connecting with a mating coupling 80 of a second function flow line (not shown). To prevent installation error, the second function block 5 may have an identifier engraved in one or both sides thereof, such as by laser etching or dot peening. The second function block 5 may also have one or more indentations formed in a lower face thereof for mating with the respective dowel pins 21.

A seal groove may be formed in an outer surface of the front stinger 78*e* and a seal, such as an o-ring 23*c*, and a backup ring 24*c* may be disposed in the seal groove for isolating an interface between the second function block 5 and the function seal plate 8. The o-ring 23*c* may be located in the seal groove adjacent the function seal plate 8 and the backup ring 24*c* located distal from the function seal plate 8. The o-ring 23*c* may have a large cross-sectional diameter relative to the ring diameter, such as a ratio (cross-sectional diameter divided by ring diameter) greater than or equal to two-tenths.

The second function block 5 may also have one or more (not shown) holes, each hole extending through upper and lower faces thereof for receiving the respective fasteners 22. Each hole may be located at a periphery of the second function block 5 so as to straddle the second function channel without intersecting therewith. Each hole may be counterbored or countersunk so that a head of the respective fastener 22 is flush or sub-flush with the upper face of the second function block 5. The second function block 5 may also have a front shoulder formed in a lower portion thereof for mating with an adjacent portion of the function seal plate flange and a rear shoulder formed in the lower portion thereof for mating with the respective body flange.

To form the upper assembly, the stinger 78*d* of the first function block 4 may be stabbed into the correct receptacle 76*b, c* of the function seal plate 8 until the rear face of the first function block engages the front flat face of the function seal plate and the rear shoulder of the first function block engages the adjacent portion of the flange of the function seal plate. The stinger 78*e* of the second function block 5 may be stabbed into the correct receptacle 76*b, c* of the function seal plate 8 until the front face of the second function block engages the rear flat face of the function seal plate and the front shoulder of the second function block engages the adjacent portion of the flange of the function seal plate. To prevent assembly error, the receptacles 76*b, c* of the function seal plate 8 and the stingers 78 of the function blocks 4, 5 may be asymmetric such that the receptacles 76*b, c* will only accept the correct function blocks.

The lower stinger 78*c* of the function seal plate 8 may then be stabbed into the upper transverse bore 70 of the body 2 while ensuring the indentations of the first 4 and second 5 function blocks receive the respective dowel pins 21 and until the flange of the function seal plate engages the body upper face and the front shoulder of the first function block engages the front flange of the body and the rear shoulder of the second function block engages the rear flange of the body. During stabbing, the o-ring 19 may engage the lower stinger 78*c* of the function seal plate 8, thereby isolating an interface between the function seal plate and the body 2. The fasteners 22 may then be inserted into the respective holes of the first 4 and second 5 function blocks and screwed into the respective sockets of the body 2, thereby connecting the upper assembly to the body.

The housing 9 may be tubular, extend through the body front face, and may have a rear coupling 80 formed in an outer surface thereof. The rear coupling 80 may have a threaded pin for engagement with the threaded box of the body front coupling 80 and a seal groove. A seal, such as an o-ring 25, may be disposed in the seal groove for engaging the seal receptacle 76 of the body front coupling 80, thereby isolating an interface between the body 2 and the housing 9. The housing 9 may also have a front coupling 80 (not shown) for connection to a control sub (not shown) of a downhole tool (not shown).

The operating rod 12 may be disposed in and extend through a bore of the housing 9. The operating rod 12 may have a front coupling 80 (not shown), a shaft, and a rear stinger 78. The front coupling 80 may be formed in a front end of the operating rod 12 for connection to an actuator (not shown) of the control sub. The shaft of the operating rod 12 may connect the front coupling 80 and the rear stinger 78. The rear stinger 78 may extend through the front portion of the body guide wall and be sized to form a sliding fit therewith. The rear stinger 78 may have a coupling 80, such as a threaded pin, formed in a rear end thereof.

The stopping rod 13 may be disposed in the rear portion of the body bore. The stopping rod 13 may have a head, a shaft and a stinger 78. The stinger 78 may extend through the rear portion of the body guide wall and be sized to form a sliding fit therewith. The stinger 78 may have a coupling 80, such as a threaded pin, formed in a rear end thereof. The head may have an enlarged diameter relative to the stinger 78 and may be between the stoppers 11*b,f* in the closed position. An outer diameter of the head may be greater than an inner diameter of the stoppers 11*b,f*, thereby trapping the head between the stoppers. The trap may be longer than the head to accommodate longitudinal movement of the slider 1*s* between the positions of the valve 1. The head may have one or more (pair shown) vent ports formed therethrough.

The seal carrier 14 may be cylindrical, may have a longitudinal axis transverse to the body longitudinal axis, and may be disposed in the body chamber 74. The body chamber 74 may be annular and may be defined radially by an inner surface of the adjacent body guide wall and longitudinally between the upper face of the supply seal plate 7 and the lower face of the function seal plate 8. A diameter of the body chamber 74 may be greater than an outer diameter of the seal carrier 14 to accommodate longitudinal movement of the slider 1*s* between the positions of the valve 1. A height of the body chamber 74 may correspond to a height of the seal carrier 14 to torsionally connect the seal carrier to the body 2. The seal carrier 14 may have a front coupling 80 and a rear coupling 80, such as threaded boxes, formed in an outer surface thereof. The front coupling 80 may be engaged with the rear coupling 80 of the operating rod 12, thereby forming a shouldered connection between the seal carrier 14 and the operating rod. The rear coupling 80 may be engaged with the front coupling 80 of the stopping rod 13, thereby forming a shouldered connection between the seal carrier 14 and the stopping rod. Outer portions of upper and lower faces of the seal carrier 14 may be tapered to discourage erosion of the seal carrier 14 during longitudinal movement of the slider 1*s* between the positions of the valve 1 and/or during venting.

The supply seal 15 and the function seal 16 may each be a mechanical seal ring made from an abrasion resistant material, such as a ceramic-metal composite (aka cermet). The cermet may be tungsten carbide. Each of the supply 15 and function 16 seals may have a diameter corresponding to, such as being slightly greater than, a stroke of the slider 1*s*. The supply seal plate 7 and function seal plate 8 may also be made from the abrasion resistant material. The supply seal 15 and the function seal 16 may be disposed in a bore of the seal carrier 14 in opposing fashion. The seal carrier 14 may also have upper and lower seal grooves formed in an inner surface thereof. A seal, such as an o-ring 26*u,b*, and a backup ring 27*u,b* may be disposed in each seal groove and each seal may be engaged with an outer surface of the respective supply 15 and function 16 seals, thereby isolating interfaces between the supply and function seals and the seal carrier 14. The o-rings 26*u,b* may each be located in the seal groove distal from the respective seal plates 8, 7 and the backup rings 26*u,b* located adjacent to the respective seal plates 8, 7.

The spring 18 may include an o-ring 18*o* and a pair of backup rings 18*u,b* straddling the o-ring. The o-ring 18*o* may be made from an elastomer or elastomeric copolymer. The spring 18 may be disposed between and have ends pressing against opposing faces of the supply 15 and function 16 seals, thereby operating as a compression spring biasing the supply and function seals away from each other and into engagement with the respective seal plates 7, 8. The supply seal 15 and the function seal 16 may each have a recess formed in the opposing faces thereof adjacent to respective bores thereof. One of the recesses (function seal 16 shown) may be threaded for receiving a threaded end of the gland 17, thereby connecting the gland and the function seal. The gland 17 may extend along an inner surface of the spring 18 to the other recess (supply seal 15 shown). A clearance may exist between the gland 17 and the other recess. The o-ring may 18*o* may be in engagement with an inner surface of the seal carrier 14 and an outer surface of the gland 17.

In the closed position, the seal carrier 14 may be centrally located in the body bore, the passage of the supply block 3 may be in alignment with the bore of the supply seal 15, and the bore of the function seal 16 may be aligned with a solid portion of the lower face of the function seal plate 8 while the upper face of the function seal covers both function channels thereof and engages the solid portion of the function plate lower face. Each bore of the supply seal 15 and the function seal 16 may have a larger diameter in a portion adjacent to the respective seal plate 7, 8 and may funnel to a smaller diameter in a portion adjacent to the other of the supply and function seals. The seal carrier bore may be pressurized from fluid communication with the supply passage and the pressure may be exerted on the opposing faces and recess ends of the supply seal 15 and the function seal 16 tending to push the rings outward. This outward force may be counteracted by the supply pressure exerted on a downwardly facing portion of the inner surface of the supply seal 15 and an upwardly facing portion of the inner surface of the function seal 16.

Since the lower face of the supply seal 15 and a portion of the upper face of the function seal 16 are engaged with the respective seal plates 7, 8, the exposed area of the counteracting portions is less than the exposed area of the outwardly forcing portions, thereby resulting in a net outward force exerted by the supply pressure on the supply seal 15 and the function seal 16. This net outward force may act in conjunction with the force of the spring 18 to firmly press adjacent faces of the supply 15 and function 16 seals into engagement with the respective seal plates 7, 8. Energization of the supply 15 and function 16 seals may isolate the supply passage and seal carrier bore from the function passages and body bore, thereby closing the valve 1.

Should pressure in either function channel exert a sufficient force on the function seal 16 to overcome the energization forces, the function seal may move downward (not shown) to disengage from the function seal plate 8, thereby allowing relief of fluid from the function channels to the body chamber 74. The relieved fluid may flow from the body chamber 74, through the rear ports of the body guide wall, through the vent ports of the stopping rod head, and into a rear vent portion of the body longitudinal bore 72. The relieved fluid may continue from the vent portion into the wellbore.

The supply seal bore larger portion may have a greater diameter than the function seal bore larger portion, thereby justifying the orientation identifier. Alternatively, the passages of the function seal plate 8 may be arranged such that the supply seal bore and the function seal bore may be identical, thereby obviating the need for the orientation identifier.

FIG. 3 is a cross section with the valve 1 in a first function position. To move the slider 1*s* to the first function position, the control sub may pull 28*f* the operating rod 12, thereby moving the seal carrier 14 forward until the head of the stopping rod 13 engages the front stopper 11*f*, thereby exposing the function seal bore to the first function channel of the function seal plate 8 and exposing the second function channel of the function seal plate to the body chamber 74. A diameter of the enlarged portion of the supply seal bore may be sufficient to maintain exposure thereof to the supply passage.

Pressurized operating fluid, such as drilling mud, may then flow from the supply flow line, through the receiver of the supply block 3, through the channel 105 of the supply block 3, through the passage of the supply seal plate 7, through the bore of the supply seal 15, through the bore of the gland 17, through the bore of the function seal 16, through the front passage 95 of the function seal plate 8, through the channel of the first function block 4, through the receiver of the first function block and to the first function flow line for activating a first function of the downhole tool. Operating fluid from the second function channel of the function seal plate 8 may flow from the body chamber 74, through the rear ports of the body guide wall, through the vent ports of the stopping rod head, and into the rear vent portion of the body longitudinal bore 72. The vented fluid may continue from the vent portion into the wellbore.

FIG. 4 is a cross section with the valve 1 in a second function position. To move the slider 1*s* to the second function position, the control sub may push 28*b* the operating rod 12, thereby moving the seal carrier 14 backward until the head of the stopping rod 13 engages the rear stopper 11*b*, thereby exposing the function seal bore to the second function channel of the function seal plate 8 and exposing the first function channel of the function seal plate to the body chamber 74. A diameter of the enlarged portion of the supply seal bore may be sufficient to maintain exposure thereof to the supply passage.

The pressurized operating fluid may then flow from the supply flow line, through the receiver of the supply block 3, through the channel 105 of the supply block 3, through the passage of the supply seal plate 7, through the bore of the supply seal 15, through the bore of the gland 17, through the bore of the function seal 16, through the rear passage 93 of the function seal plate 8, through the channel of the second function block 5, through the receiver of the second function block and to the second function flow line for activating a second function of the downhole tool. Operating fluid from the first function channel of the function seal plate 8 may flow from the body chamber 74, through the rear ports of the body guide wall, through the vent ports of the stopping rod head, and into the rear vent portion of the body longitudinal bore 72. The vented fluid may continue from the vent portion into the wellbore.

Figure 5:
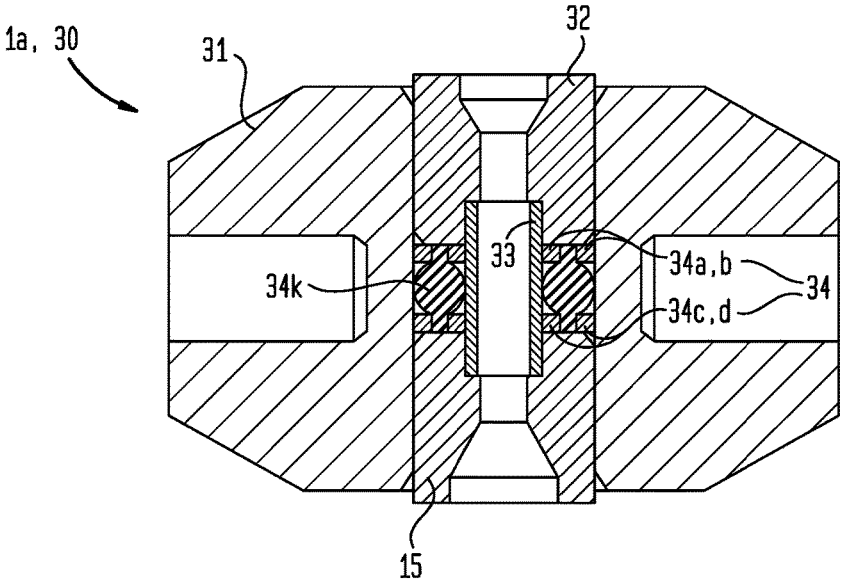
FIG. 5 illustrates an alternative sliding seal assembly for use with the valve instead of the seal assembly of FIG. 2B, according to another embodiment of the present disclosure.

FIG. 5 illustrates an alternative sliding seal assembly 30 for use with the valve 1 instead of the seal assembly 10, according to another embodiment of the present disclosure. Substitution of the alternative sliding seal assembly 30 for the seal assembly 10 may form an alternative valve 1*a*. The alternative sliding seal assembly 30 may include a carrier 31, the supply seal 15, a function seal 32, a gland 33, and a spring-seal 34. The seal carrier 31 may be similar to the seal carrier 14 except for omission of the seal grooves. The function seal 32 may be similar to the function seal 16 except for omission of the thread.

The spring-seal 34 may include a key seal 34*k*, a pair of upper backup rings 34*a,b*, and a pair of lower backup rings 34*c,d*. Each pair of backup rings 34*a-d* may straddle respective portions of the key seal 34*k*. The spring-seal 34 may be disposed between and have ends pressing against opposing faces of the supply 15 and function 32 seals, thereby operating as a compression spring biasing the supply and function seals away from each other and into engagement with the respective seal plates. The gland 33 may have ends received in the recesses and may extend along an inner surface of the spring-seal 34. A clearance may exist between the gland 33 and ends of the recesses. The key seal 34*k* may be in engagement with an inner surface of the seal carrier 31 and an outer surface of the gland 33, thereby isolating an inner interface between the function 32 and supply 15 seals and the gland and isolating an outer interface between the function and supply seals and the seal carrier.

The key seal 34*k* may be a ring having a composite shaped cross section. The cross section may have a mid circular seal portion, an upper lobe extending from the mid seal portion, and a lower lobe extending from the mid seal portion. The lobes may be aligned with the mid portion. A thickness of the mid portion may be greater or substantially greater than, such as three-halves or twice, the thickness of each lobe. Each lobe may have a rectangular portion connecting to the seal portion and a rounded end distal from the seal portion. Each pair of backup rings 34*a-d* may straddle the respective lobe.

Figure 6:
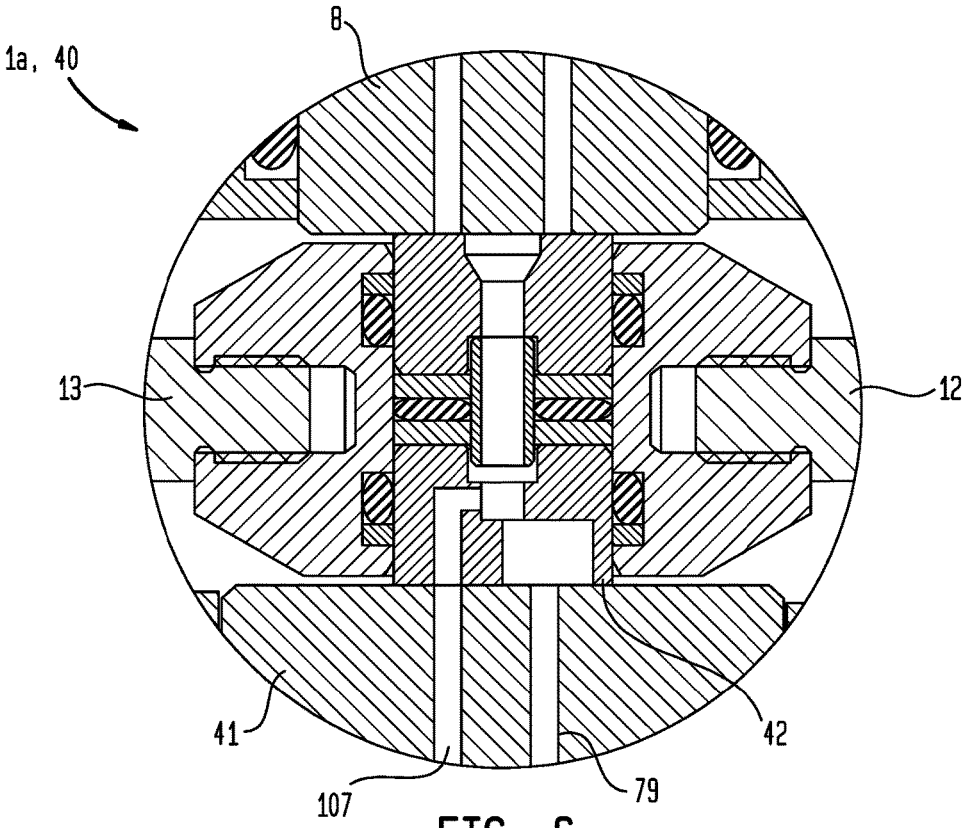
FIG. 6 illustrates an alternative modular directional control valve having a third function position instead of a closed position, according to another embodiment of the present disclosure.

FIG. 6 illustrates an alternative modular directional control valve 1*b* having a third function position instead of a closed position, according to another embodiment of the present disclosure. The alternative valve 1*b* may be similar to the valve 1 except for having a third function block (not shown) instead of the dummy block 6, a modified seal assembly 40 accommodating the third function block, and a modified supply seal plate 41 accommodating the third function block.

The modified supply seal plate 41 may be similar to the supply seal plate 7 except for the lower receiver also having a rear receptacle 76 and, in addition to passage 79, rear passage 107 (additional passage). The rear receptacle 76 may extend from the respective flat face to a mid portion thereof without intersecting the front receptacle 76. The rear passage 107 may extend from the respective seal receptacle 76, through the stinger 78 portion, and to an upper face thereof without intersecting the supply passage. To prevent assembly error, the rear receptacle 76 may be asymmetric such that the rear receptacle 76 will only accept the third function block.

The third function block may be similar to the dummy block 6 except for also having a rear coupling 80, a cylindrical front stinger 78, and a channel extending from the coupling 80 and through the stinger 78. The rear coupling 80 may be threaded for connecting with a mating coupling 80 of a third function flow line (not shown). To prevent installation error, the third function block may have an identifier engraved in one or both sides thereof, such as by laser etching or dot peening. A seal groove may be formed in an outer surface of the stinger 78 and a seal, such as an o-ring, and a backup ring may be disposed in the seal groove for isolating an interface between the third function block and the modified supply seal plate 41. The o-ring may be located in the seal groove adjacent the modified supply seal plate 41 and the backup ring located distal from the modified supply seal plate. The o-ring may have a large cross-sectional diameter relative to the ring diameter, such as a ratio (cross-sectional diameter divided by ring diameter) greater than or equal to two-tenths.

The modified seal assembly 40 may be similar to the seal assembly 10 except for having a modified supply seal 42 instead of the supply seal 15 and for being scaled. The modified supply seal 42 may be similar to the supply seal 15 except for being scaled and having a branched passage formed therethrough instead of a bore. The branched passage may include an upper trunk having the recess for receiving the gland, a supply branch extending from the trunk to a lower face of the modified supply seal 42 and a third function branch extending from the trunk to a lower face. In the third function position (shown), the third function branch may be aligned with the third function passage of the modified supply seal plate 41 and the supply branch may be aligned with the supply passage of the modified supply seal plate. A diameter of the supply seal branch may be sufficient to maintain exposure thereof to the supply passage in the first and second function positions (not shown). In the first and second function positions, the third function passage may be closed by engagement with a solid portion of the modified supply seal 42.

Alternatively, the third function passage may be vented in the first and second function positions. Alternatively, the modified seal assembly 40 may have the spring seal 34.

Figure 7:
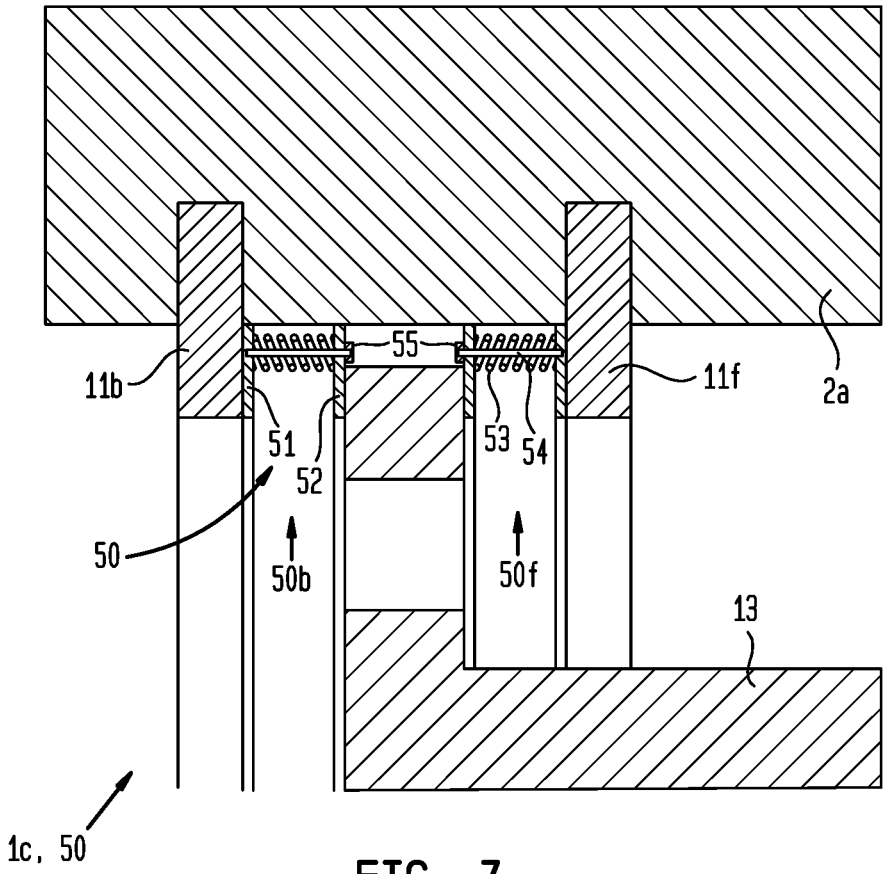
FIG. 7 illustrates an alternative modular directional control valve having a detent for the closed position, according to another embodiment of the present disclosure.

FIG. 7 illustrates an alternative modular directional control valve 1*c* having a detent 50 for the closed position, according to another embodiment of the present disclosure. The alternative valve 1*c* may be similar to any of the valves 1, 1*a* except for having the detent 50 and a slightly modified body 2*a* for accommodating the detent. The detent 50 may also be used with the valve 1*b* for biasing the valve toward the third function position.

The detent 50 may include a pair of opposed spring assemblies 50*f,b*, each including a pair of end rings 51,52, a spring 53 disposed between the end rings, and a guide rod 54 extending through the spring and connected to the end plates. The front detent 50*f* may be disposed between a front face of the head of the stopping rod 13 and a rear face of the front stopper 11*f*. The rear detent 50*f* may be disposed between a rear face of the head of the stopping rod 13 and a front face of the rear stopper 11*b*.

Each spring 53 may be a compression spring longitudinally movable between an extended position (shown) and a retraced position (not shown). Ends of each spring 53 may bear against the respective end rings 51, 52, thereby biasing the end rings away from each other. The extended position of each spring 53 may only be partially extended as each spring may be restrained from full extension by the respective guide rod 54. Each guide rod 54 may have a first end connected to a respective first end ring 51, such as by threads, and a second end extending through a hole of the respective second end ring 52. The guide rod second end may also be threaded for receiving a nut 55, thereby allowing limited longitudinal movement of the guide rod 54 relative to the second end ring 52. Each guide rod 54 may also have a stop shoulder formed in an outer surface thereof for preventing bottom out of the respective spring 53. In order to actuate the alternative valve 1*c* to either function position, the control sub actuator may supply sufficient force to overcome the respective opposing spring 53. Unintentional drifting of the alternative valve 1*c* from the closed position to either respective position is resisted by the bias of the respective spring 53.

Figure 8:
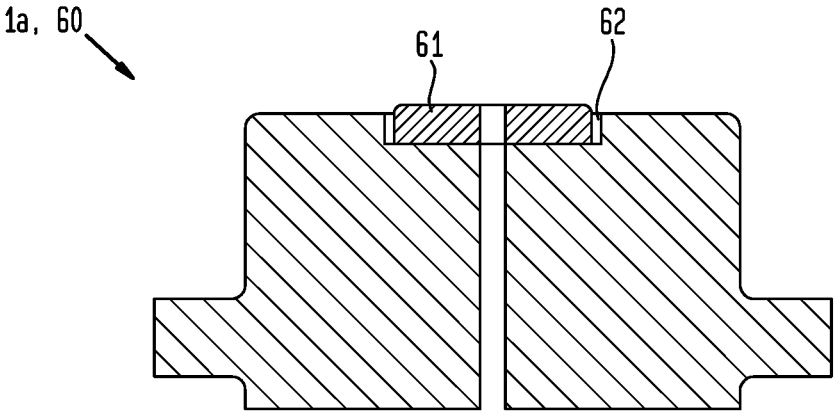
FIG. 8 illustrates an alternative supply seal plate for use with the valve, according to another embodiment of the present disclosure.

FIG. 8 illustrates an alternative supply seal plate 60 for use with any of the valves 1, 1*a*, 1*c* or use with the valve 1*b* with appropriate modification, according to another embodiment of the present disclosure. Substitution of the alternative supply seal plate 60 for the supply seal plate 7 may form an alternative valve 1*d*.

The alternative supply seal plate 60 may be similar to the supply seal plate 7 except for having a seal insert 61 instead of an upper sealing face, thereby allowing the alternative seal plate to be made one of the metals or alloys discussed above for the valve 1 instead of the cermet. The alternative supply seal plate 60 may have a groove formed in the upper face thereof for receiving the insert 61. The insert 61 and supply seal (not shown) may be made from a ceramic, such as synthetic corundum. The insert 61 may be attached, such as brazed 62, to the alternative supply seal plate 60. The insert 61 may have a height corresponding to a height of the groove, such as being slightly greater than, such that the insert protrudes from the groove to engage the supply seal. The insert 61 may be cylindrical and have a diameter sufficient to maintain engagement with the supply seal across each position of the alternative valve 1*d*. The function seal plate (not shown) of the alternative valve 1*d* may also be modified to have a seal insert and the seal insert and function seal (not shown) may be made from the ceramic as well.

Alternatively, the inserts 61 and seals may be made from cubic boron nitride or synthetic diamond instead of the ceramic.

Alternatively, the dummy block 6 may be omitted from any of the valves 1, 1*a*, 1*c*, 1*d*.

While the foregoing is directed to embodiments of the present disclosure, other and further embodiments of the disclosure may be devised without departing from the basic scope thereof, and the scope of the invention is determined by the claims that follow.

The invention claimed is:

1. A directional control valve, comprising:

a base, comprising:

a body having a longitudinal bore, a transverse bore, a chamber formed at an intersection between the longitudinal and transverse bores and an exterior;

a supply seal plate having a first stinger disposed inwardly of the transverse bore, a first receptacle, and a supply passage extending from the first receptacle through the first stinger, wherein at least the portion of the supply seal plate including the first receptacle extends outwardly of the transverse bore;

a supply block fastened to the exterior of the body and having a second stinger disposed in the first receptacle and a first coupling for connection to a flow line;

a function seal plate having a third stinger disposed inwardly of the transverse bore, second and third receptacles, and passages extending from the second and third receptacles through the third stinger wherein at least a portion of the function seal plate extends outwardly of the transverse bore; and first and second function blocks fastened to the exterior of the body and having respective fourth and fifth stingers disposed in the respective second and third receptacles and respective second and third couplings for connection to flow lines; and a slider longitudinally movable relative to the base and comprising:

a sliding seal assembly disposed in the chamber; and an operating rod fastened to the seal assembly.

2. The valve of claim 1, wherein:

a portion of the transverse bore receiving the supply seal plate has a first diameter, a portion of the transverse bore receiving the function seal plate has a second diameter, the first and second diameters are not equal, and the greater of the first and second diameters is also greater than or equal to an outer diameter of the sliding seal assembly.

3. The valve of claim 1, wherein each of the supply and first and second function blocks and the rectangular body have asymmetric locator profiles such that each block can only be fastened to the body at a correct location.

4. The valve of claim 1, wherein the receptacles and stingers are each asymmetric such that each receptacle will only accept the correct one of the supply and first and second function blocks.

5. The valve of claim 1, wherein:

the slider is movable between first and second function positions, and the valve further comprises first and second stoppers for halting the slider at the respective function positions.

6. The valve of claim 5, wherein the slider is further movable to a third position.

7. The valve of claim 6, wherein:

the third position is a closed position, and the valve further comprises a dummy block fastened to the body adjacent to the supply seal plate.

8. The valve of claim 6, wherein:

the supply seal plate has an additional passage extending through the first stinger, and the third position is a third function position.

9. The valve of claim 6, further comprising a detent for retaining the valve in the third position.

10. The valve of claim 9, wherein the detent comprises a pair of opposed spring assemblies.

11. A directional control valve, comprising:

a base, comprising:

a rectangular body having a longitudinal bore, a transverse bore, and a chamber formed at an intersection between the bores;

a supply seal plate having a first stinger disposed in the transverse bore, a first receptacle, and a passage extending from the first receptacle through the first stinger;

a supply block fastened to the body and having a second stinger disposed in the first receptacle and a first coupling for connection to a flow line;

a function seal plate having a third stinger disposed in the transverse bore, second and third receptacles, and passages extending from the second and third receptacles through the third stinger; and first and second function blocks fastened to the body and having respective fourth and fifth stingers disposed in the respective second and third receptacles and respective second and third couplings for connection to flow lines; and a slider longitudinally movable relative to the base and comprising:

a sliding seal assembly disposed in the chamber; and an operating rod fastened to the seal assembly, wherein the sliding seal assembly comprises;

a cylindrical seal carrier;

a pair of opposed supply and function mechanical seals disposed in a bore of the seal carrier;

a gland disposed between the supply and function seals, and a spring disposed between the supply and function seals for biasing the supply and function seals into engagement with the respective seal plates.

12. The valve of claim 11, wherein the spring comprises an o-ring and a pair of backup rings.

13. The valve of claim 11, wherein:

the spring comprises a key seal and two pairs of backup rings, each pair of backup rings straddles a respective lobe of the key seal, and the key seal is engaged with the seal carrier and the gland, thereby isolating an inner interface between the function and supply seals and the gland and isolating an outer interface between the function and supply seals and the seal carrier.

14. The valve of claim 11, wherein:

each seal plate has a groove formed in an end face of the respective stinger, the valve further comprises an insert disposed in each groove and attached to the respective seal plate, and each insert and each seal are made from synthetic conundrum.

15. The valve of claim 11, wherein:

the base further comprises a housing connected to the body and extending through an end face of the body, and the operating rod extends through a bore of the housing.

16. The valve of claim 11, wherein:

the slider further comprises a second rod fastened to the seal assembly, the body has a guide wall formed adjacent to the chamber, and each rod extends through the guide wall, and each rod forms a sliding fit with the guide wall.

17. The valve of claim 11, wherein each block has a channel extending from the respective coupling and through the respective stinger.

18. The valve of claim 11, wherein:

each block has a first shoulder adjacent to the stinger, each seal plate has a flange adjacent to the stinger, and engagement of the respective shoulders and flanges retains the seal plates to the body.

19. The valve of claim 18, wherein:

each block has a second shoulder adjacent to the coupling, the body has flanges at longitudinal ends thereof, and engagement of the respective shoulders and flanges facilitates assembly of the valve.

* * * * *